US005192122A

United States Patent [19]

Hill

[11] Patent Number: 5,192,122

[45] Date of Patent: Mar. 9, 1993

[54] CARROUSEL TOOL BOX WITH LOCKING CRANK

[76] Inventor: Leroy Hill, Rte. 2, Box 57-A, Smithville, Ark. 72466

[21] Appl. No.: 787,417

[22] Filed: Nov. 4, 1991

[51] Int. Cl.[5] ..... A47B 49/00

[52] U.S. Cl. ..... 312/267; 312/902; 74/526; 74/527; 74/528; 74/557

[58] Field of Search ..... 312/267, 305, 319.2, 312/322, 902; 16/324; 74/523, 526, 527, 528, 557

[56] References Cited

U.S. PATENT DOCUMENTS

| | | | |
|---|---|---|---|
| 425,215 | 4/1890 | Franklin . | |
| 522,485 | 7/1894 | Phenice . | |
| 557,948 | 4/1896 | Bever . | |
| 1,204,059 | 11/1916 | Phenice | 312/267 |
| 2,551,283 | 5/1951 | Parr . | |
| 2,646,891 | 7/1953 | Morgan . | |
| 2,661,259 | 12/1953 | Rippon | 312/267 |

FOREIGN PATENT DOCUMENTS

| | | | |
|---|---|---|---|
| 659370 | 1/1987 | Switzerland | 312/322 |
| 220855 | 8/1924 | United Kingdom | 74/528 |

*Primary Examiner*—Kenneth J. Dorner
*Assistant Examiner*—Brian K. Green
*Attorney, Agent, or Firm*—Walker, McKenzie & Walker

[57] ABSTRACT

A carrousel tool box having a cabinet, a carrousel of trays mounted for rotation within the cabinet, and a shaft attached to the carrousel along the axis of rotation of the carrousel of trays and extending outwardly through the cabinet, with a locking crank for turning the shaft. The locking crank includes an arm attached to the shaft, a handle pivotally mounted to the end of the arm, a fulcrum on the arm, a spring-biased locking pin which engages with openings in a plate on the cabinet, and a lever pivoted on the fulcrum and operated by the handle for causing the locking pin to lock or unlock the rotation of the carrousel in response to movement of the handle from a locking position to a cranking position. The arm has guides for constraining the lever to sit on the fulcrum and for limiting the movement of the lever. The tool box has various drawers and a lid with side slots which slidably and pivotally hinge on a pair of hinge posts on the sides of the cabinet.

6 Claims, 2 Drawing Sheets

FIG. 5
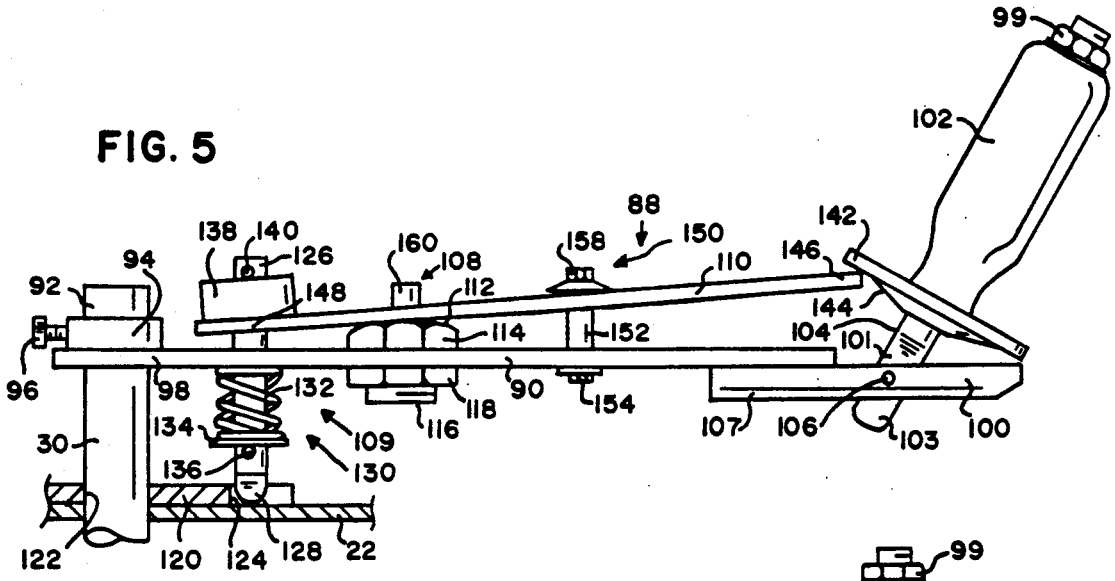
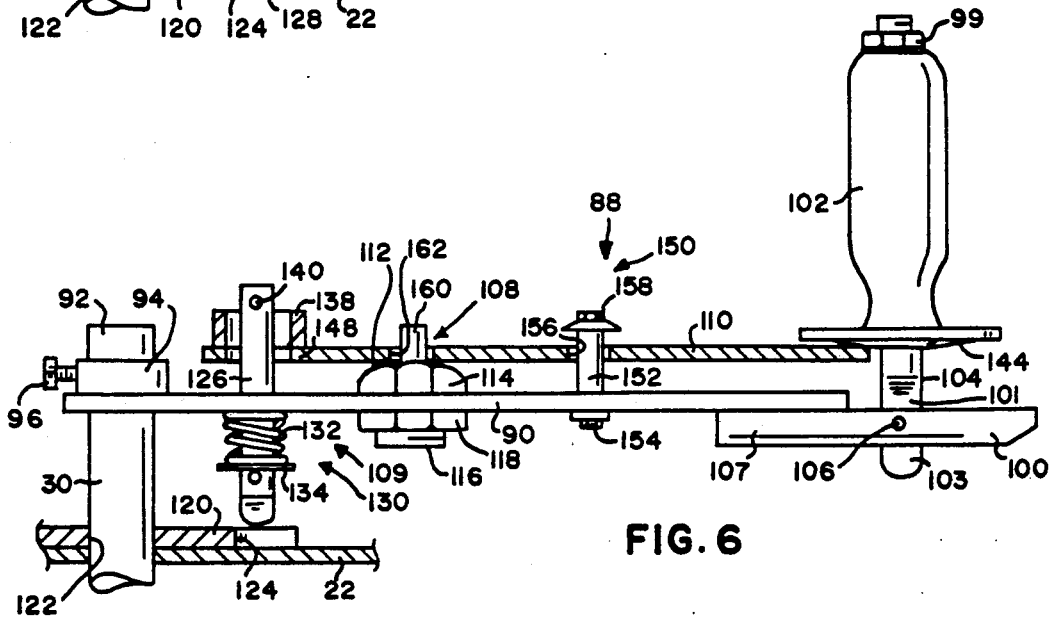
FIG. 6
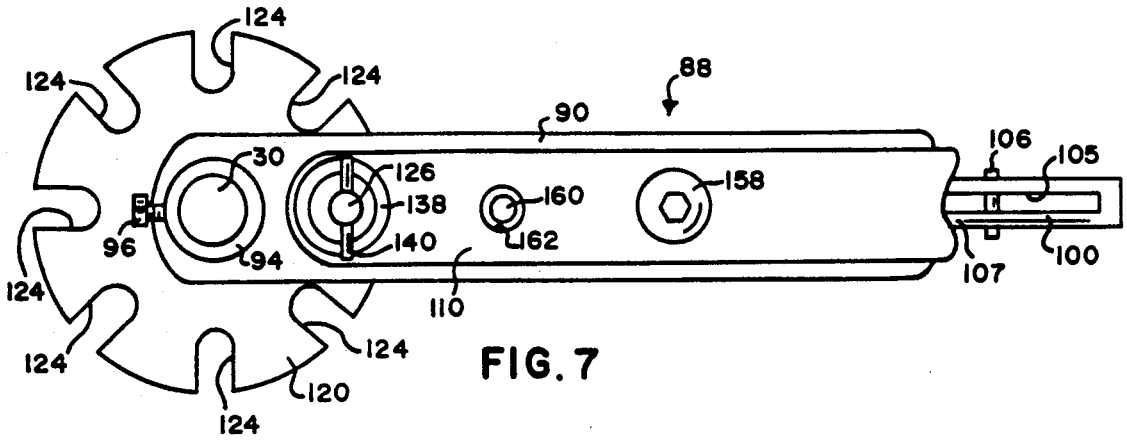
FIG. 7

CARROUSEL TOOL BOX WITH LOCKING CRANK

BACKGROUND OF THE INVENTION

1. Field of the Invention

The present invention relates, in general, to tool boxes, and in particular, to carrousel tool boxes with multiple rotating trays.

2. Information Disclosure Statement

Home craftsmen often store tools in tool boxes. Well-known solutions for organizing and storing tools in tool boxes include carrousel tool boxes, in which a multiplicity of trays are attached to carrousel disks which rotate within the tool box to bring selected tools into view. Two known problems of such carrousel tool boxes are that of rotating the carrousel of trays as well as that of anchoring or locking the carrousel once the selected tools are within view.

It is therefore desirable to have an improved carrousel tool box which simply and easily allows a craftsman to rotate trays of tools within the tool box into view, and then automatically locks the carrousel of trays in position when rotation is not desired.

A preliminary patentability search in Class 312, subclasses 134, 135, 266, 267, and 268, produced the following patents, some of which may be relevant to the present invention: Franklin, U.S. Pat. No. 425,215, issued Apr. 8, 1890; Phenice, U.S. Pat. No. 522,485, issued Jul. 3, 1894; Bever, U.S. Pat. No. 557,948, issued Apr. 7, 1896; Parr, U.S. Pat. No. 2,551,283, issued May 1, 1951; and Morgan, U.S. Pat. No. 2,646,891, issued Jul. 28, 1953.

While each of the above patents disclose various hinging apparatus or interlocking hanging systems, none disclose or suggest the present invention. More specifically, none of the above patents disclose or suggest an improved carrousel tool box having a cabinet, a carrousel of trays mounted for rotation within the cabinet, and a shaft attached to the carrousel along the axis of rotation of the carrousel of trays and extending outwardly through the cabinet, wherein the improvement comprises a locking crank means for turning the shaft, thereby rotating the carrousel of trays, and for locking the shaft from turning, said crank means comprising: an arm attached to the shaft and extending radially outward therefrom, said arm having a proximate end adjacent the shaft and having a remote end distant from the shaft; a handle pivotally mounted to said remote end for movement in a radial plane of the shaft, said handle having a cranking position and a locking position; a fulcrum attached to said arm between said remote and proximate ends; locking means for allowing and preventing the turning of the shaft; and, lever means pivoted on said fulcrum and operated by said handle for causing said locking means to prevent the turning of the shaft when said handle is in said locking position, and for causing said locking means to allow the turning of the shaft when said handle is in said cranking position.

Franklin, U.S. Pat. No. 425,215, describes a carrousel tool chest having opposing and manually operated locking pawls which engage ratchet teeth on the carrousel. The present invention has no such opposing locking pawls.

Phenice, U.S. Pat. No. 522,485, describes a carrousel kitchen cabinet with various drawers and a hand crank that rotates the carrousel of shelves through a worm gear mechanism. The present invention has no such worm gear mechanism, and the Phenice device does not show nor describe a locking mechanism for the carrousel.

Bever, U.S. Pat. No. 557,948, describes a cabinet show case having a carrousel of display shelves rotated by a crank and gearing mechanism, with a sliding bolt for locking the crank at a given position. The present invention has no separately operable locking bolt, and requires no gearing mechanism.

Parr, U.S. Pat. No. 2,551,283, describes a fishing tackle box with carrousel trays and a hinged lid, but describes no crank or carrousel locking mechanism.

Morgan, U.S. Pat. No. 2,646,891, also describes a fishing tackle box with carrousel trays, and describes a frictional brake to prevent rotation of the carrousel. No crank nor locking mechanism is described similar to the present invention.

SUMMARY OF THE INVENTION

The present invention is an improved carrousel tool box having a cabinet, a carrousel of trays mounted for rotation within the cabinet, and a shaft attached to the carrousel along the axis of rotation of the carrousel of trays and extending outwardly through the cabinet, wherein the improvement comprises a locking crank means for turning the shaft, thereby rotating the carrousel of trays, and for locking the shaft from turning. The improvement may also comprise a lid for the cabinet, said lid having a slot on opposing sides that is slidably and rotatably pivoted on respective hinge posts on the sides of the cabinet.

It is an object of the present invention to provide means for simply and easily rotating the carrousel of trays within the tool box into view, and then automatically locking the carrousel of trays in position when rotation is not desired. It is a further object to provide various drawers in the cabinet for compact storage of tools therein, and to provide a cabinet lid that may be easily opened and shut.

BRIEF DESCRIPTION OF THE DRAWINGS

FIG. 5 is a view of the crank means of the present invention, showing the handle in the locking position.

FIG. 6 is a view of the crank means of the present invention, similar to FIG. 5, except with the handle in the cranking position, and showing a sectional view of the lever means.

FIG. 7 is a view of the crank means of the present invention, taken at right angles with respect to FIG. 5, except with the handle removed.

DESCRIPTION OF THE PREFERRED EMBODIMENT

Figure 1:
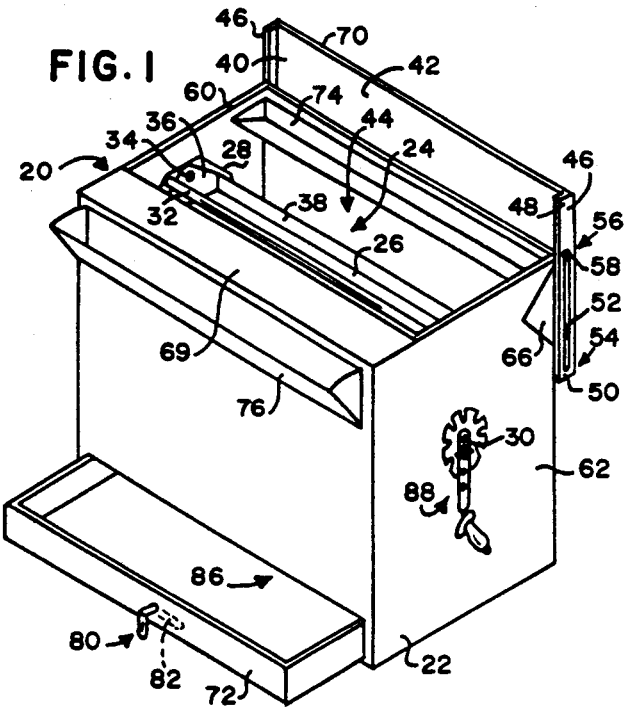
FIG. 1 is a perspective view of the present invention with drawers extended and lid opened, showing the crank means and carrousel of trays.
Figure 2:
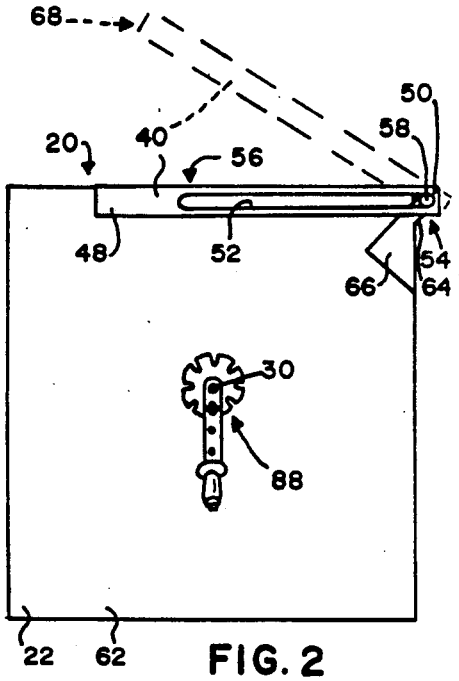
FIG. 2 is a side view of the present invention, showing the crank means and the movement of the lid.
Figure 3:
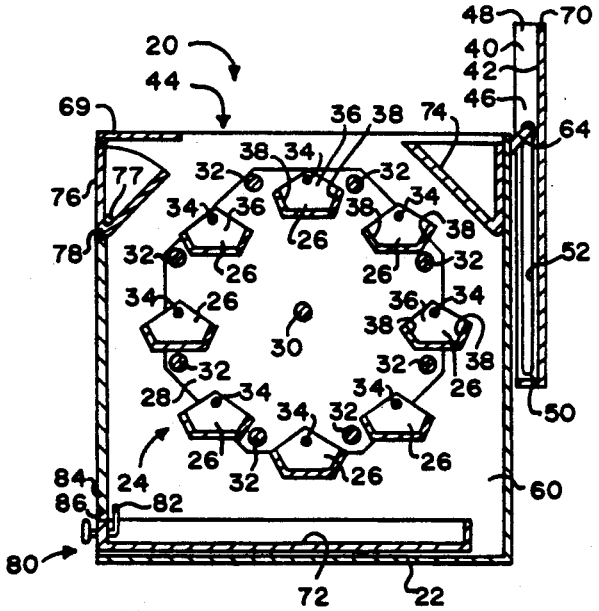
FIG. 3 is a sectional side view of the present invention showing the carrousel of trays.
Figure 4:
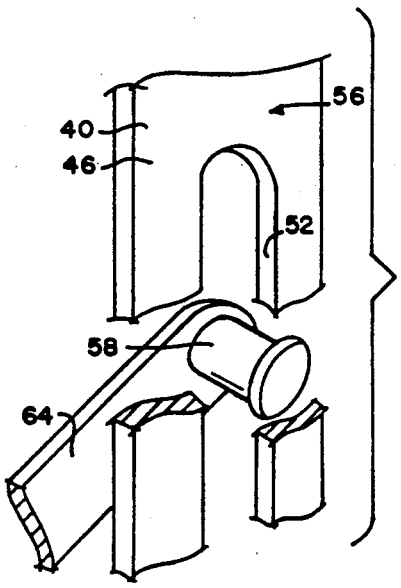
FIG. 4 is a partial sectional perspective view showing the details of a hinge post and slot in the side of the lid.

Referring to FIGS. 1–3, the improved carrousel tool box 20 is seen to have a cabinet 22 and a carrousel 24 of trays 26 mounted for rotation within cabinet 22. Carrousel 24 comprises a pair of disks 28, preferably octagonal, and a shaft 30 attached to disks 28 along the axis of rotation of carrousel 24 of trays 26. Shaft 30 is received for rotation within a pair of bearings or bushings, not shown, in the well-known manner, one on either side of cabinet 22. The rigidity of carrousel 24 is maintained by a plurality of spacers or rods 32 which fixedly space the pair of disks 28 apart in a manner well-known to those skilled in the art. Each of trays 26 hangs on either end thereof from bolts 34 that pivotally attach the ends 36 of trays 26 to disks 28 as shown in FIGS. 1 and 3. Trays 26 are attached to disks 28 at points near the circumferences of disks 28 and preferably spaced apart at a uniform angle from one another, and will be understood to hang by the forces of gravity from bolts 34. Preferably, the front and rear sides 38 of trays 36 are angled apart at the tops thereof as shown.

Referring to FIGS. 1-4, tool box 20 may have an improved lid 40 for cabinet 22, said lid having a surface 42 for covering access opening 44 of cabinet 22. Lid 40 has left and right sides 46, each side 46 having a front end 48 and a back end 50, and each side 46 further having a slot 52 extending from a point 54 adjacent back end 50 to a point 56 remote from back end 50. Tool box 20 also may have a pair of hinge posts 58 attached to left and right sides 60, 62 of cabinet 22 and extending through slots 52. Preferably, hinge posts 58 are mounted on upwardly extending supporting members 64 of bracket 66 attached, as by welding or bolting, to left and right sides 60, 62 of cabinet 22. It shall now be understood that slots 52 allow lid 40 to be slidably and rotatably pivoted on hinge posts 58.

To raise lid 40 from its closed position shown in FIG. 2 to its opened position shown in FIGS. 1 and 3, lid 40 is simply lifted through an intermediate position 68 shown in FIG. 2, rotatably pivoting about hinge posts 58, then allowed to slidably move rearwardly and downwardly with hinge posts 58 sliding in slots 52 from point 54 adjacent back end 50 to point 56 remote from back end 50, until lid 40 comes to rest in the opened position shown in FIGS. 1 and 3. The closure of lid 40 will be understood to involve complementary reverse movements to those just described, lifting and sliding lid 40 on hinge posts 58, and then lowering lid 40 over opening 44. Preferably, cabinet 22 has a top panel 69 at the front portion of opening 44, with front edge 70 of lid 40 extending to panel 69 for closure of opening 44 when lid 40 is in the closed position. An advantage of the present improved lid 40 over a simple hinged design is the ease of access of front edge 70 of lid 40 when in the opened position, allowing a craftsman to reach edge 70 for closure of lid 40 without stooping over to reach edge 70, as might otherwise be required were lid 40 to simply be hinged to cabinet 22.

Referring to FIGS. 1 and 3, tool box 20 may have a first drawer 72 within cabinet 22 below carrousel 24, a wedge-shaped compartment 74 fixedly mounted in the upper rear of cabinet 22 for access from above through access opening 44, and a wedge-shaped second drawer 76 hingeably mounted, as with hinge pins 77, at the apex 78 thereof in the upper front of cabinet 22. First drawer 72 may have a well-known combination handle latch 80, said latch 80 having a locked position shown in FIG. 3 in which catch 82 engages the lip 84 of opening 86 through which drawer 72 slides, and having an unlocked position shown in FIG. 1 allowing drawer 72 to be opened in a manner that is well-known to those skilled in the art. The wedge shape of compartment 74 and second drawer 76 allows efficient storage use of the otherwise wasted corner space within cabinet 22 surrounding carrousel 24. Preferably, panel 69 extends over and covers second drawer 76 when drawer 76 is closed as shown in FIG. 3.

Tool box 20 also includes as an improvement a locking crank means 88 for turning shaft 30, thereby rotating carrousel 24 of trays 26, and for locking shaft 30 from turning. Referring to FIGS. 5-7, crank means 88 comprises an arm 90 securely attached to an end 92 of shaft 30 extending outwardly through cabinet 22. Arm 90 is preferably attached to shaft 30 using a well-known bushing 94, welded or otherwise fixedly attached to arm 90, and set screw 96, and extends radially outward from shaft 30. Arm 90 will be understood to have a proximate end 98 adjacent shaft 30 and a remote end 100 distant from shaft 30.

Crank means 88 also comprises a handle 102 pivotally mounted, as on rod 104 pivoting about pin 106, to remote end 100 for movement within a radial plane of shaft 30. Handle 102 may be secured to rod 104 as by nut 99. Preferably, end 101 of rod 104 is tapered to a flattened portion 103 inserted within slot 105 of integral arm extension 107 welded or otherwise attached to arm 90. Rod 104 will be understood to fit loosely through handle 102, allowing handle 102 to rotate thereabout as crank means 88 is used to turn shaft 30 in a manner hereinafter described. Handle 102 pivots between a locking position shown in FIG. 5 and a cranking position shown in FIG. 6, both hereinafter described.

Crank means 88 further comprises a fulcrum 108 attached to arm 90 between remote and proximate ends 100, 98, locking means 109 for allowing and preventing the turning of shaft 30, as well as lever means 110 pivoted on fulcrum 108 and operated by handle 102 for causing locking means 109 to prevent the turning of shaft 30 when handle 102 is in the locking position shown in FIG. 5, and for causing locking means 109 to allow the turning of shaft 30 when handle 102 is in the cranking position shown in FIG. 6. Preferably, fulcrum 108 is the upper rounded surface 112 of a nut 114 attached to arm 90 as by threaded rod 116 extending through a hole in arm 90 and threaded into opposing nuts 114 and 118 on opposite sides of arm 90. Upper rounded surface 112 will be understood to allow lever means 110 to pivotally rock thereon.

Locking means 109 preferably comprises a plate 120 fixedly attached to the side 62 of cabinet 22, with plate 120 having a center hole 122 through which shaft 30 extends and further having a multiplicity of openings 124, such as holes or preferably slots, each spaced a radial distance from center hole 122. Additionally, locking means 109 preferably includes a locking pin 126 movable by lever means 110 and mounted on arm 90 in radial alignment with said multiplicity of openings 124 for insertion into a selected one of said openings 124 in a manner hereinafter described. Preferably, the end 128 of pin 126 adjacent openings 124 is tapered for ease of insertion into openings 124. Finally, locking means 109 preferably further comprises means 130 for biasing pin 126 toward said multiplicity of openings 124.

The preferred embodiment of means 130 for biasing pin 126 is a spring 132 operating against pin 126 and the underside of arm 90, compressed against a washer 134 held onto locking pin 126 by pin 136 therethrough.

Locking pin 126 is secured for responsive movement with lever means 110, preferably by bushing 138 attached to lever means 110 and anchoring pin 140 through locking pin 126 in a manner that will now be apparent. Handle 102 has a rim 142 extending outwardly therefrom, preferably with a convex lower surface 144, for actuating and moving near end 146 of lever means 110 toward arm 90 as handle 102 moves from its angled locking position shown in FIG. 5 to its upright cranking position shown in FIG. 6, in a manner that will now be apparent. This movement of near end 146 of lever means 110 towards arm 90 necessarily causes far end 148 of lever means 110 to move away from arm 90 as lever means 110 pivots on fulcrum 108, thereby moving and lifting pin 126 from within one of openings 124 and thereby allowing crank means 88 to turn shaft 30 relative to plate 120. When arm 90 moves from the cranking position to the locking position, means 130 for biasing pin 126, operating against arm 90 and pin 126, causes pin 126 to extend toward plate 120, and, when in alignment with a selected one of openings 124, to be inserted therein, thereby locking arm 90 from angular movement relative to plate 120, and thereby preventing the turning of shaft 30 in a manner that will now be apparent.

Finally, arm 90 may additionally comprise guide means 150 for constraining the movement of lever means 110, preferably guide post 152 secured to arm 90 by screw 154 passing therethrough, guide post 152 also passing through a hole 156 in lever means 110 and terminating in a lipped screw 158. Guide means 150 also preferably comprises a post 160 attached to threaded rod 116 and extending outwardly through a hole 162 in lever means 110. It will be understood that post 160 constrains lever means 110 to sit on fulcrum 108, while post 152 constrains the upward pivoting movement of lever means end 146, and also constrains lever means 110 to be substantially aligned along arm 90.

To use the present invention, a craftsman need merely lift lid 40 to its opened position shown in FIG. 1, grab handle 102 and move it to the cranking position shown in FIG. 6, and turn crank means 88 until the desired tray 26 of tools comes into view. Upon releasing handle 102, locking means 109 will automatically lock shaft 30 from further turning, in a manner previously described, and tools may be removed from or replaced into the desired tray 26. Also, tools in wedge-shaped compartment 74 may be accessed once lid 40 is opened, and tools within first and second drawers 72, 76 by merely opening them.

Although the present invention has been described and illustrated with respect to a preferred embodiment and a preferred use therefor, it is not to be so limited since modifications and changes can be made therein which are within the full intended scope of the invention.

I claim:

1. An improved carrousel tool box having a cabinet, a carrousel of trays mounted for rotation about an axis within the cabinet, and a shaft attached to the carrousel of trays along the axis of rotation of the carrousel of trays and extending outwardly through the cabinet, wherein the improvement comprises a locking crank means for turning the shaft, thereby rotating the carrousel of trays, and for locking the shaft from turning, said crank means comprising:

(a) an arm attached to the shaft and extending radially outward therefrom, said arm having a proximate end adjacent the shaft and having a remote end distant from the shaft;

(b) a handle pivotally mounted to said remote end for movement in a radial plane of the shaft, said handle having a cranking position and a locking position;

(c) a fulcrum attached to said arm between said remote and proximate ends;

(d) locking means for allowing and preventing the turning of the shaft; and (e) lever means pivoted on said fulcrum and operated by said handle for causing said locking means to prevent the turning of the shaft when said handle is in said locking position, and for causing said locking means to allow the turning of the shaft when said handle is in said cranking position.

2. The tool box as recited in claim 1, wherein said locking means comprises:

(a) a plate attached to the cabinet, said plate having a center hole through which said shaft extends, said plate further having a multiplicity of openings each spaced a radial distance from said center hole;

(b) a pin movable by said lever means and mounted on said arm in radial alignment with said multiplicity of openings for insertion into one of said multiplicity of openings; and (c) means for biasing said pin toward said multiplicity of openings.

3. The tool box as recited in claim 2, wherein said means for biasing comprises a spring operating against said arm and said pin.

4. The tool box as recited in claim 2, wherein said arm comprises a guide means for constraining the movement of the lever means.

5. The tool box as recited in claim 1 in which the cabinet has a left and a right side, and wherein the improvement additionally comprises:

(a) a lid for the cabinet, said lid having a surface for covering the cabinet and said lid having a left and a right side, each said side of said lid having a front and a back end and having a slot extending from a point adjacent said back end to a point remote from said back end;

(b) a pair of hinge posts attached to the left and right sides of the cabinet and extending through said slots on said left and right sides, respectively, of said lid.

6. An improved carrousel tool box having a cabinet, a carrousel of trays mounted for rotation about an axis within the cabinet, and a shaft attached to the carrousel of trays along the axis of rotation of the carrousel of trays and extending outwardly through the cabinet, wherein the improvement comprises a locking crank means for turning the shaft, thereby rotating the carrousel of trays, and for locking the shaft from turning, said crank means comprising:

(a) an arm attached to the shaft and extending radially outward therefrom, said arm having a proximate end adjacent the shaft and having a remote end distant from the shaft;

(b) a handle pivotally mounted to said remote end for movement in a radial plane of the shaft, said handle having a cranking position and a locking position;

(c) a fulcrum attached to said arm between said remote and proximate ends;

(d) locking means for allowing and preventing the turning of the shaft, said locking means comprising:

i. a plate attached to the cabinet, said plate having a center hole through which said shaft extends, said plate further having a multiplicity of openings each spaced a radial distance from said center hole;

ii. a pin movable by said lever means and mounted on said arm in radial alignment with said multiplicity of openings for insertion into one of said multiplicity of openings; and iii. means for biasing said pin toward said multiplicity of openings, said means for biasing comprising a spring operating against said arm and said pin; and (e) lever means pivoted on said fulcrum and operated by said handle for causing said locking means to prevent the turning of the shaft when said handle is in said locking position, and for causing said locking means to allow the turning of the shaft when said handle is in said cranking position;

in which the cabinet has a left and a right side and a front and a rear, and wherein said improvement further comprises:

(a) a lid for the cabinet, said lid having a surface for covering the cabinet and said lid having a left and a right side, each said side of said lid having a front and a back end and having a slot extending from a point adjacent said back end to a point remote from said back end;

(b) a pair of hinge posts attached to the left and right sides of the cabinet and extending through said slots on said left and right sides, respectively, of said lid;

(c) a first drawer in the cabinet below the carrousel of trays;

(d) a wedge-shaped compartment mounted in the rear of the cabinet from access from above; and (e) a wedge-shaped second drawer having an apex and being hingeably mounted at the apex thereof in the front of the cabinet.

* * * * *